US005904428A

United States Patent [19]

Shimamura

[11] Patent Number: 5,904,428

[45] **Date of Patent: *May 18, 1999**

[54] PRINT CONTROL APPARATUS AND METHOD

[75] Inventor: Yoshiyuki Shimamura, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/540,464

[22] Filed: Oct. 10, 1995

[30] Foreign Application Priority Data

Oct. 13, 1994 [JP] Japan ..... 6-247756

[51] Int. Cl.[6] ..... B41J 11/42

[52] U.S. Cl. ..... 400/582; 400/61; 395/113

[58] Field of Search ..... 400/61, 70, 76, 400/663, 669, 582, 63; 361/680, 681, 683; 395/111, 113, 114

[56] References Cited

U.S. PATENT DOCUMENTS

| | | | |
|---|---|---|---|
| 3,924,723 | 12/1975 | Cooper et al. | 400/63 |
| 4,558,965 | 12/1985 | Ueda et al. | 400/76 |
| 5,115,374 | 5/1992 | Hongoh | 361/681 |
| 5,345,403 | 9/1994 | Ogawa | 364/708.1 |
| 5,555,349 | 9/1996 | Miyasaka et al. | 395/111 |
| 5,604,844 | 2/1997 | Nishiyama | 395/111 |

FOREIGN PATENT DOCUMENTS

| | | |
|---|---|---|
| 312407 A3 | 4/1989 | European Pat. Off. . |
| 458572 A3 | 11/1991 | European Pat. Off. . |
| 501789 A3 | 9/1992 | European Pat. Off. . |
| 2-69271 | 3/1990 | Japan . |
| 4-329166 | 11/1992 | Japan . |
| 5-294027 | 11/1993 | Japan . |
| 2159101 | 11/1985 | United Kingdom . |

OTHER PUBLICATIONS

"Enhanced Sheet Feeder Operations", IBM Technical Disclosure Bulletin, vol. 31, No. 5, Oct. 1988, pp. 255–257.

*Primary Examiner*—John Hilten
*Attorney, Agent, or Firm*—Fitzpatrick, Cella, Harper & Scinto

[57] ABSTRACT

It is an object of the invention to provide print control apparatus and method such that at the time of a document processing in a non-recording mode, a recording medium is not left on a feed path. To accomplish the above object, only for a period of time during which a print menu is displayed on a display, when the recording medium is detected on a sheet sensor on the feed port side, a feed motor is rotated, thereby feeding the recording medium to a predetermined position. At a time point when the print menu is finished, when the recording medium is detected on the sheet sensor on the feed port side, the recording medium is delivered and the print menu is finished after that.

22 Claims, 10 Drawing Sheets

PRINT CONTROL APPARATUS AND METHOD

BACKGROUND OF THE INVENTION

1. Field of the Invention

The present invention relates to print control apparatus and method and, more particularly, to print control apparatus and method to control a conveyance of a recording medium in accordance with a specified state.

2. Related Background Art

Hitherto, each of document processing apparatuses such as a word processor having a printer and the like has a keyboard 1, a display 2, a memory 3, a recorder 4, and the like as shown in FIGS. 8 to 12. A feed path of a recording medium in each of the above document processing apparatuses will be described hereinbelow.

The feed path of the recording medium in the document processing apparatus as shown in FIG. 8 is a type which is considered to be most general. The recording medium is inserted from an upper feed port 55*a* of the recorder 4 locating on the rear side of the display 2 and is delivered from an upper delivery port 55*b* on the front side of the upper feed port 55*a*.

According to the document processing apparatus shown in FIG. 9, the recording medium is inserted from a rear feed port 55*a* of a recorder 4 locating on a rear side of a display 2 and is delivered from the upper delivery port 55*b*.

According to the document processing apparatus shown in FIG. 10, the recording medium is inserted from the upper feed port 55*a* of the recorder 4 locating on the front side of the display 2 and is delivered from the upper delivery port 55*b*.

According to the document processing apparatus shown in FIG. 11, the recording medium is inserted from the feed port 55*a* on the rear side of the apparatus and is delivered from the upper delivery port 55*b* of the apparatus on the front side of the display 2.

According to the document processing apparatus shown in FIG. 12, the recording medium is inserted from the feed port 55*a* on the front side of the apparatus, passes along the feed path under the keyboard 1, reaches the recorder 4 located on the rear side of the display 2, and is delivered from the rear delivery port 55*b* of the apparatus.

Among the above feed paths, however, there are many feed paths each having a curved feed path to curve the recording medium to a certain degree. There are a few feed paths each having a feed path which rectilinearly feeds the medium in the horizontal direction and is suitable for a rigid and thick recording medium, so that they are inconvenient. As shown in FIG. 12, even in the document processing apparatus having the feed path to rectilinearly feed the recording medium in the horizontal direction, in case of an apparatus such that a feed port of the recording medium is provided on the front side of the apparatus and the feed path is provided under the keyboard 1, it is difficult to set a recording medium of a small size, and it is necessary to provide a space under the keyboard 1. Therefore, the position of the keyboard 1 is high and an operating efficiency deteriorates, so that it is inconvenient.

From the drawbacks mentioned above, a document processing apparatus having a feed path shown in FIG. 2 is devised. A recording medium is inserted from the feed port 55*a* locating on the lower side of the display 2, passes along the feed path on the keyboard 1, reaches the recorder 4 locating on the rear side of the display 2, and is delivered from the delivery port 55*b* on the rear side of the apparatus.

As a method of setting the recording medium of the conventional apparatuses having the various feed paths mentioned above, a method of manually feeding the recording medium by-a platen knob or a method of automatically feeding the recording medium to a predetermined position when the recording medium is detected as disclosed in Japanese Patent Application Laid-Open No. 4-329166 or 5-294027 is used.

In case of a construction in which the portion on the keyboard is used as a feed path of the recording medium as shown in FIG. 2, however, if the construction such that when the recording medium is detected, the recording medium is simply fed as disclosed in Japanese Patent Application Laid-Open No. 4-329166 or 5-294027 is used, when the recording medium is set during the execution of a process such as a document editing other than the printing or the like, the keyboard 1 cannot be depressed, so that it is inconvenient.

Further, a print menu is finished in a state in time which the recording medium is set in a recording apparatus, the recording medium remains on the keyboard 1. Unless the recording medium Is taken out, the keyboard 1 cannot be depressed, so that It is inconvenient. In case of a recording medium in which the platen knob to manually feed the recording medium is not equipped, the recording medium cannot be taken out from the recording apparatus, so that it is inconvenient.

Further, in case of an apparatus that adjusts the from the detection of the recording medium until the conveyance of the recording medium is adjusted in accordance with a degree of the user's skill as shown in Japanese Patent Application Laid-open No. 4-329166 or 5-294027, such a time has to be adjusted each time the user changes.

SUMMARY OF THE INVENTION

According to an embodiment of the invention, it is an object of the invention to provide print control apparatus and method in which when a document is processed in a non-recording mode, the apparatus is set to a state such that a recording medium is not left on a feed path or the recording medium can immediately be taken out, and a good operating efficiency of the recording medium is obtained irrespective of a degree of the user's skill.

To accomplish the above object, according to the invention, there is provided a print control apparatus having detecting means to detect that a recording medium has been inserted to a recording medium feed position, wherein when the insertion of the recording medium is detected by the detecting means, the recording medium is fed to a predetermined position In case of a specified state.

Further, to accomplish the above object, according to the invention, there is provided a print control method having a detecting step of detecting that a recording medium has been inserted to a recording medium feed position, wherein when the insertion of the recording medium is detected in the detecting step, the recording medium is fed to a predetermined position in case of a specified state..

An automatic loading function can be turned on/off in accordance with the specified state.

The above and other objects and features of the present invention will become apparent from the following detailed description and the appended claims with reference to the accompanying drawings.

DETAILED DESCRIPTION OF THE PREFERRED EMBODIMENTS

An embodiment of a document processing apparatus according to the invention will now be described in detail hereinbelow with reference to the drawings.

Figure 1:
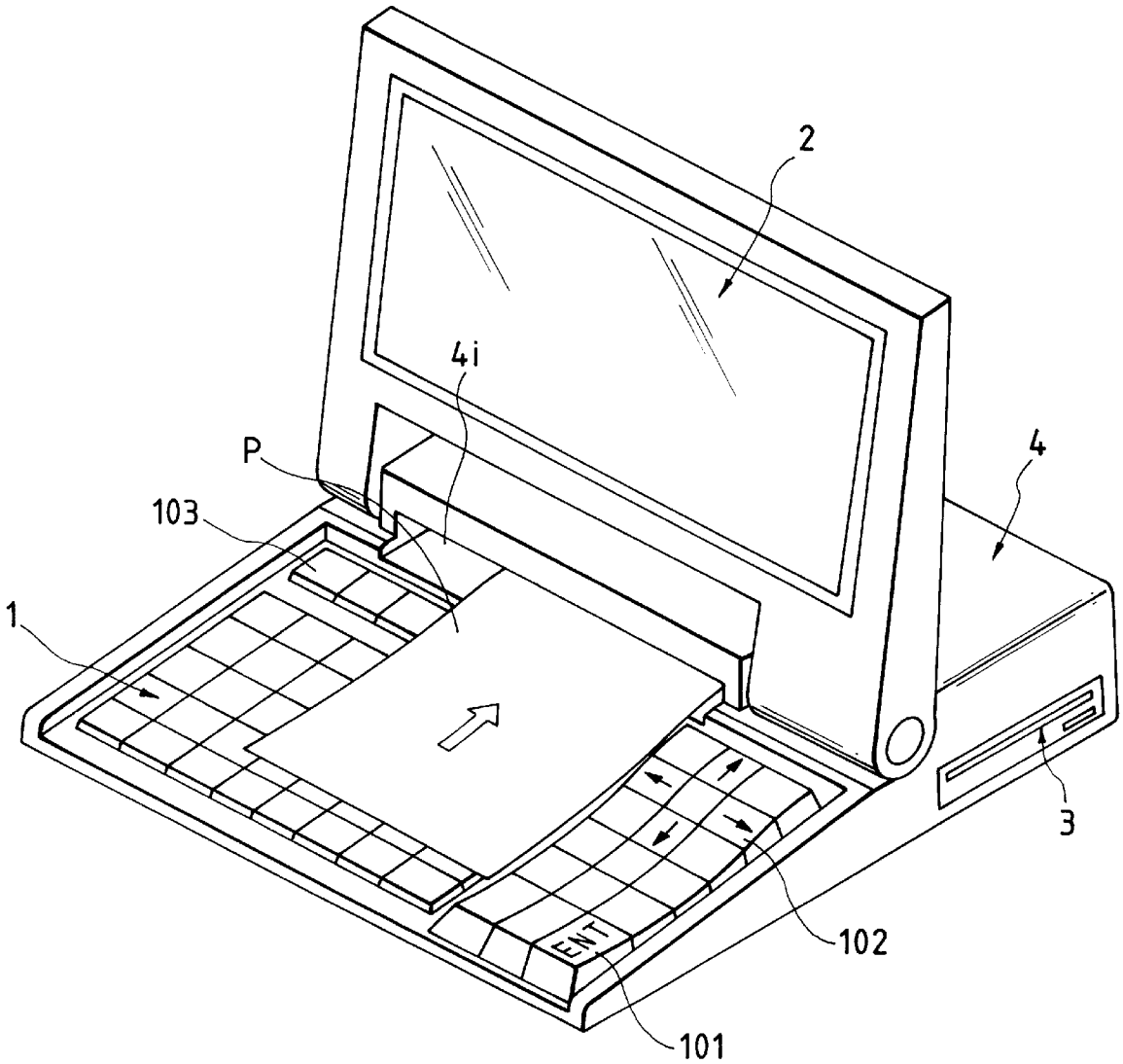
FIG. 1 is an external perspective view of a document processing apparatus to which the invention is applied.

FIG. 1 is an external perspective view of the document processing apparatus to which the invention is applied and shows a state in which a recording medium P is fed to a recording apparatus.

Figure 2:
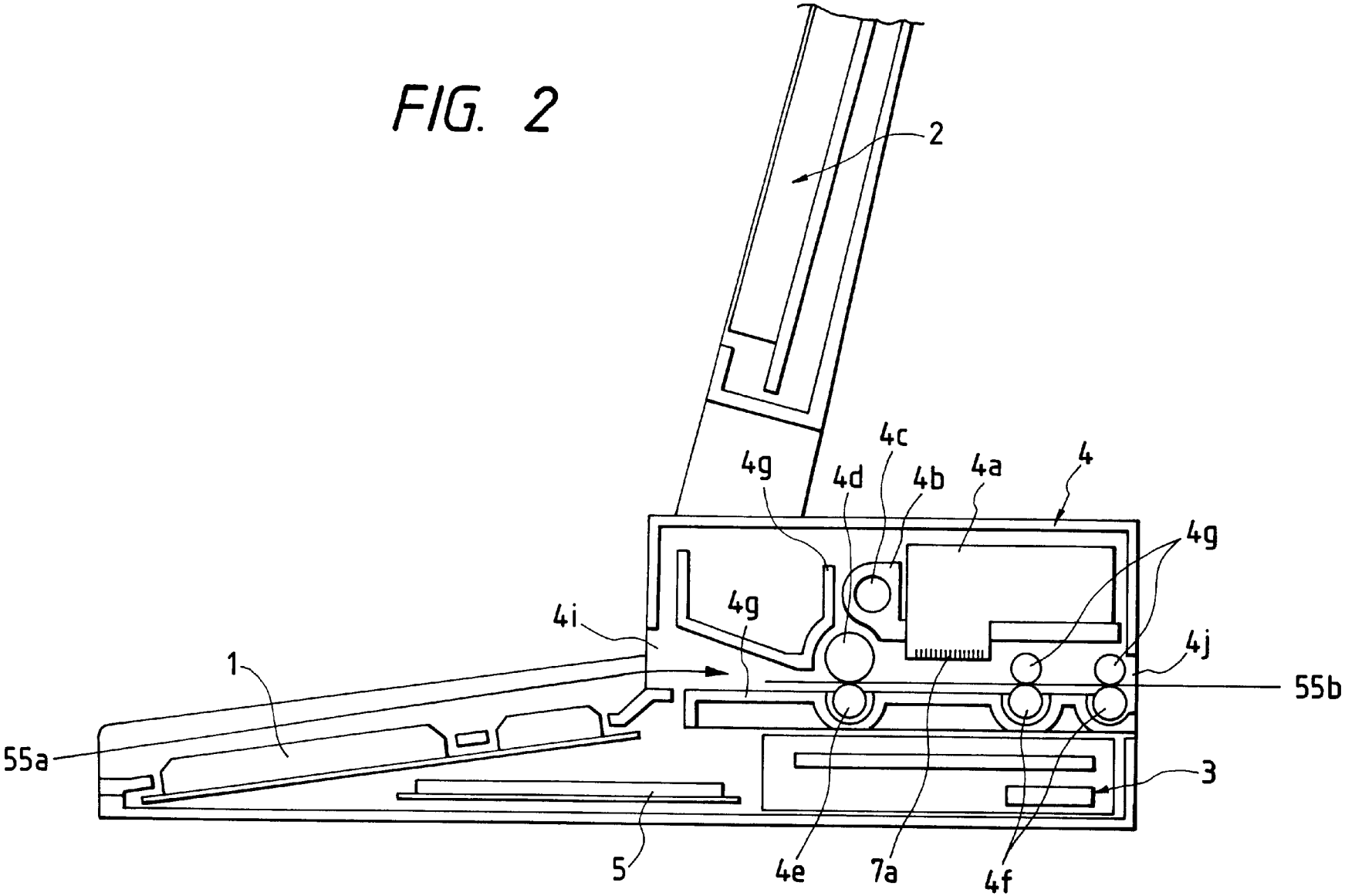
FIG. 2 is a vertical sectional view of the document processing apparatus.

FIG. 2 is a vertical sectional view of the document processing apparatus.

Figure 3:
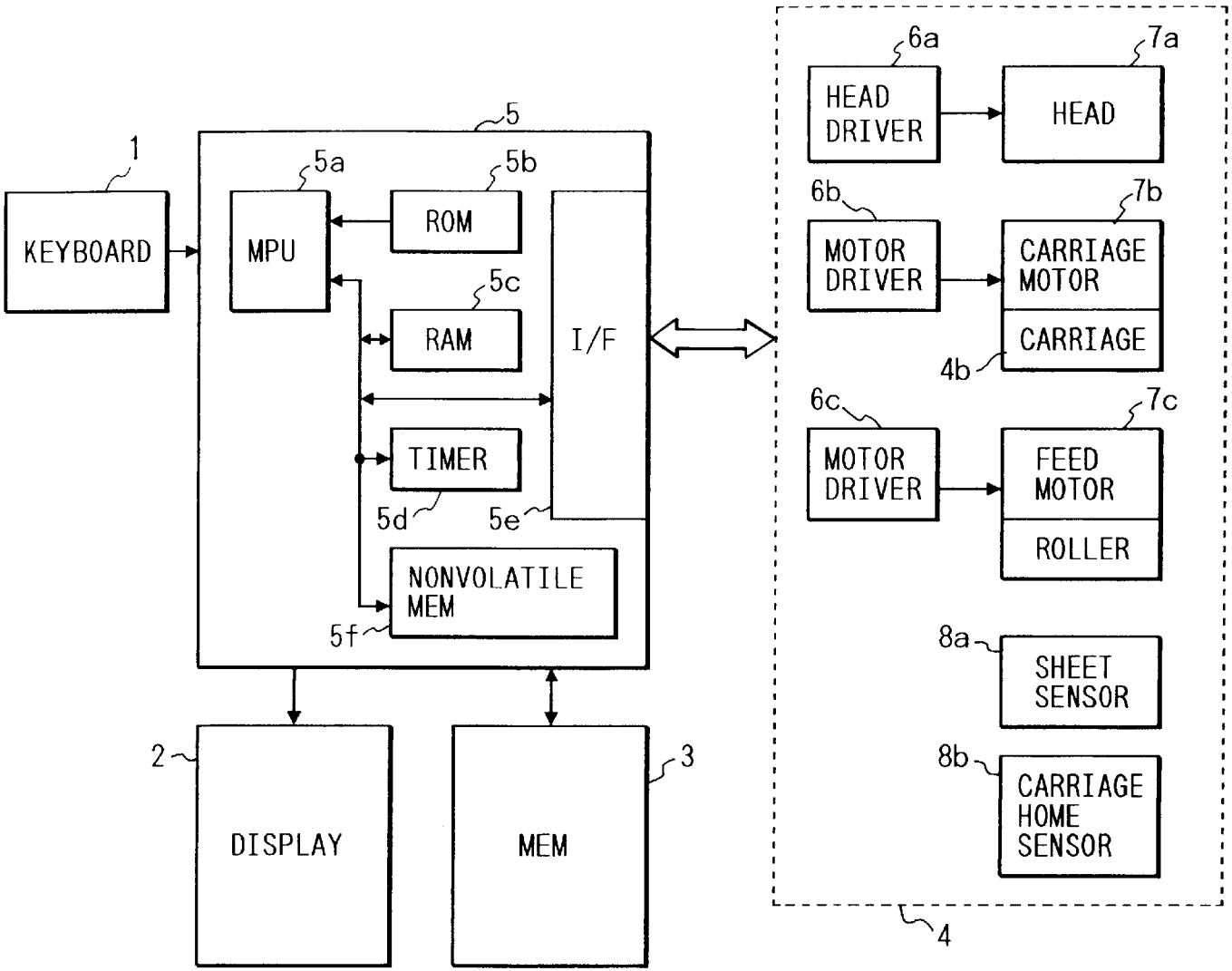
FIG. 3 is a block diagram showing a construction of a control system of the document processing apparatus.

FIG. 3 is a block diagram showing a construction of a control system of the document processing apparatus of the embodiment.

In FIG. 1, reference numeral 1 denotes the keyboard as input means for inputting information. Reference numeral 2 denotes the liquid crystal display (LCD) as a display apparatus for displaying an inputted document or the like. The display 2 is rotatably held to the apparatus main body. When the document processing apparatus is not used (for example, when it is carried, enclosed, or the like), the display 2 can be folded down so as to overlap the keyboard 2. Reference numeral 3 denotes the floppy disk drive (hereinafter, simply referred to as an FDD) as a memory device. The FDD 3 is built in the apparatus main body. A floppy disk (not shown) as a detachable memory medium is inserted into the FDD 3, thereby writing or reading out information.

As shown in FIG. 2, the recording apparatus (recorder) 4 as recording means for recording to the recording medium in accordance with information is built in an upper portion of the FDD 3. In the embodiment, an ink jet printer for recording by emitting an ink is built as a recording apparatus 4 in the FDD 3.

Reference numeral 4*a* denotes an ink cartridge comprising: a recording head portion 7*a* to emit the ink in accordance with the information; and an ink tank portion in which the ink is held. The ink cartridge 4*a* is mounted on a carriage 4*b* and scans (reciprocating movement) along a guide shaft 4*c* in the direction perpendicular to the recording medium feeding direction. In this instance, the ink is emitted from the recording head portion, thereby recording to the recording medium. A feed system of the recording medium in the recording apparatus 4 has: a feed roller 4*d* and a pinch roller 4*e* which is come into pressure contact therewith; and delivery rollers 4*f* and spurs 4*g* which are come into pressure contact therewith. Further, a feed guide 4*h* to guide the conveyance of the recording medium is provided between those rollers. In the diagram, reference numeral 4*i* denotes a feed port of the recording medium and 4*j* indicates a delivery port of the recording medium. A feed speed on the delivery roller side is set to be faster than a feed speed on the feed roller side. A tension is applied to the recording medium between the rollers so as not to bend the recording medium at the recording position that faces the recording head portion.

In the diagram, reference numeral 5 denotes a control board for controlling each unit of the apparatus. For example, the control board 5 executes information processes as a document processing apparatus, a control of the recording apparatus, and the like. As shown in FIG. 3, on the control board 5, there are installed: an MPU 5*a* for executing a control procedure according to a flowchart of FIG. 4, which will be explained hereinlater, for generating a control signal, and for controlling each unit; an ROM 5*b* in which a program corresponding to the control procedure has been stored; an RAM 5*c* which is used as a work area at the time of the execution of the control; a timer 5*d* to measure a time; an interface 5*e* to exchange a signal with the recording apparatus; a nonvolatile memory 5*f* as nonvolatile data holding means for mainly storing the accumulated number of sheets recorded by the recording apparatus, the accumulated number of cleaning times, etc.; and the like.

Data inputted by the keyboard 1 is processed in accordance with the program provided in the control board 5 and is displayed to the display 2. In case of storing the data, the data is transmitted to the memory 3 and is stored in the floppy disk. On the contrary, the data held in the floppy disk can be also called out.

Further, the data can be recorded to the recording medium by the recording apparatus 4. A head driver 6*a* and motor drivers 6*b* and 6*c* are assembled on the recording apparatus side. Those drivers drive the recording head 7*a* of the ink cartridge 4*a* to emit the ink, a carriage motor 7*b* to scan the carriage 4*b* on which the ink cartridge 4*a* is mounted, and a feed motor 7*c* to rotate each motor of the feed system to feed the recording medium, respectively. When those component elements are controlled, position information obtained from sheet sensors 8*a* which are attached on the feed port side and the delivery port side and each of which detects the presence or absence of the recording medium and a carriage home sensor 8*b* to detect whether the carriage is located at a home position or not are used. When the sheet sensor 8*a* detects the presence of the recording medium, the feed motor 7*c* is rotated, thereby feeding the recording medium to a predetermined position. "A predetermined position" in the embodiment denotes a top margin position in an area where the recording medium can be recorded by the recording head. By setting such a position to the predetermined position, the recording can be immediately executed. On the other hand, a sensor is attached on the delivery port side, the recording medium is fed from the feed port and is automatically fed. By setting such a predetermined position to the sensor position on the delivery port side, the apparatus main body can certainly know the position of the recording medium.

However, as will be also understood from FIG. 1, since a part of the keyboard 1 is also used as a feed path of the recording medium P, when the recording medium P is inserted to the feed path, processes (for example, document editing) other than the printing cannot be performed.

In the invention, therefore, only for a period of time during which a print menu is displayed, when the presence of the recording medium is detected on the sheet sensor 8*a* on the feed port side, the feed motor 7*c* is rotated and the recording medium is fed to the predetermined position. At a time point when the print menu is finished, when the presence of the recording medium is detected on the sheet sensor 8*a*, the print menu is finished after the recording medium was delivered.

Figure 4:
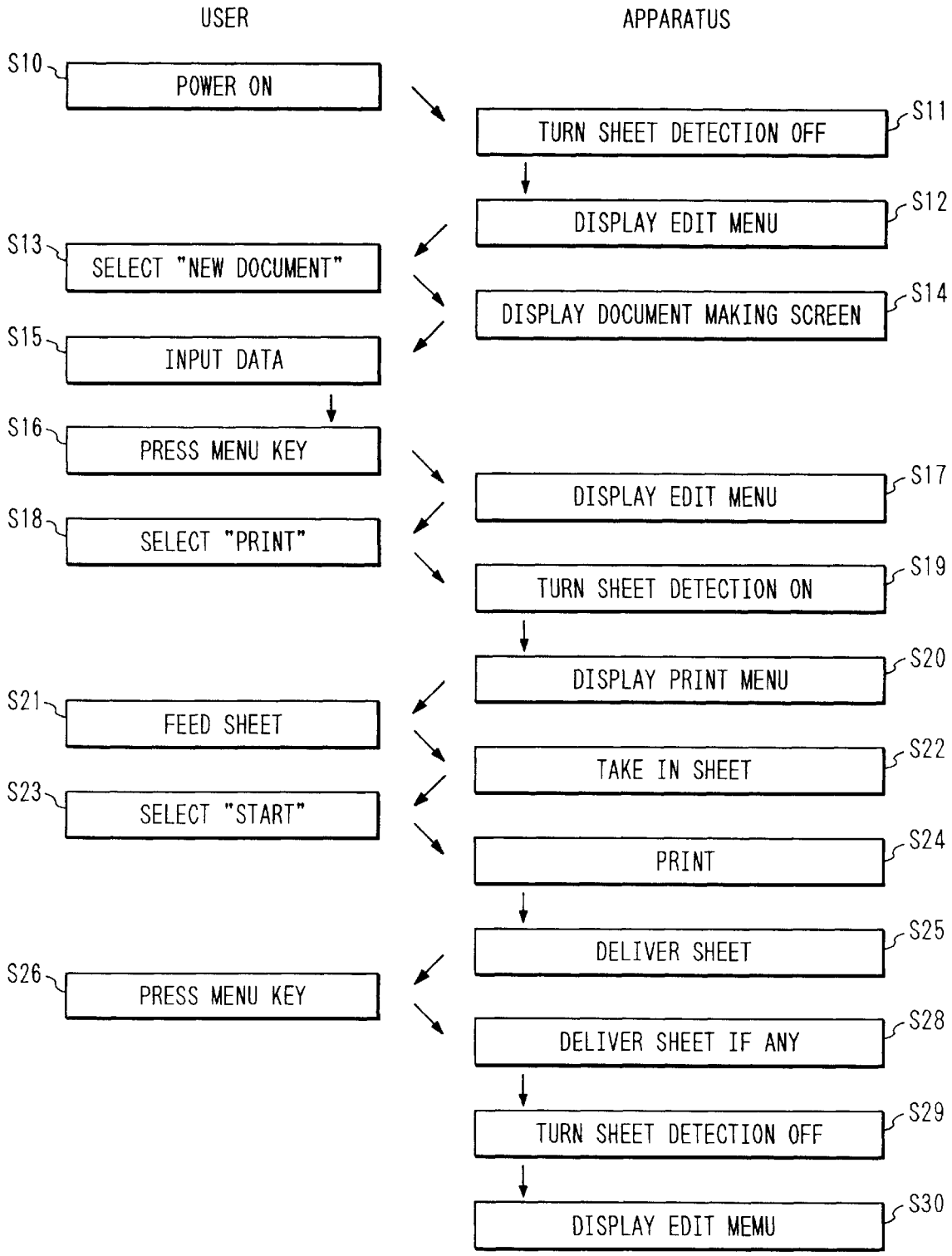
FIG. 4 is a flowchart showing "the operation that is executed by the user" and "the operation of the document processing apparatus" which are executed for a period of time from the power ON to the end of the printing of the document processing apparatus.

"the operation that is executed by the user" and "the operation of the document processing apparatus" which are executed for a period of time from the power on to the end of printing in the case where a certain specific menu is set to a print menu will now be described with reference to a flowchart of FIG. 4.

Figure 5:
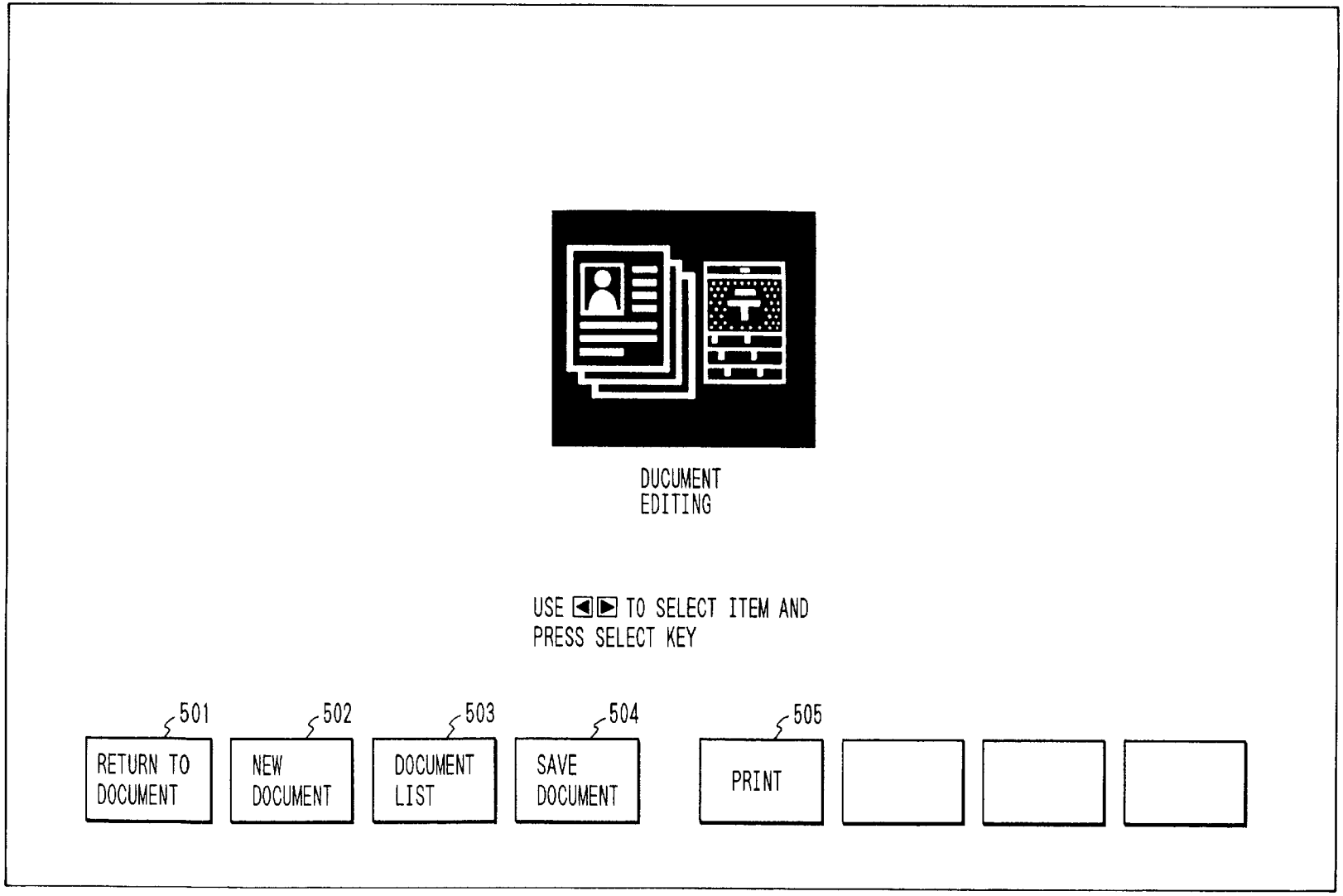
FIG. 5 is an explanatory diagram showing a document edit menu-screen which is displayed to a display of the document processing apparatus.
Figure 6:
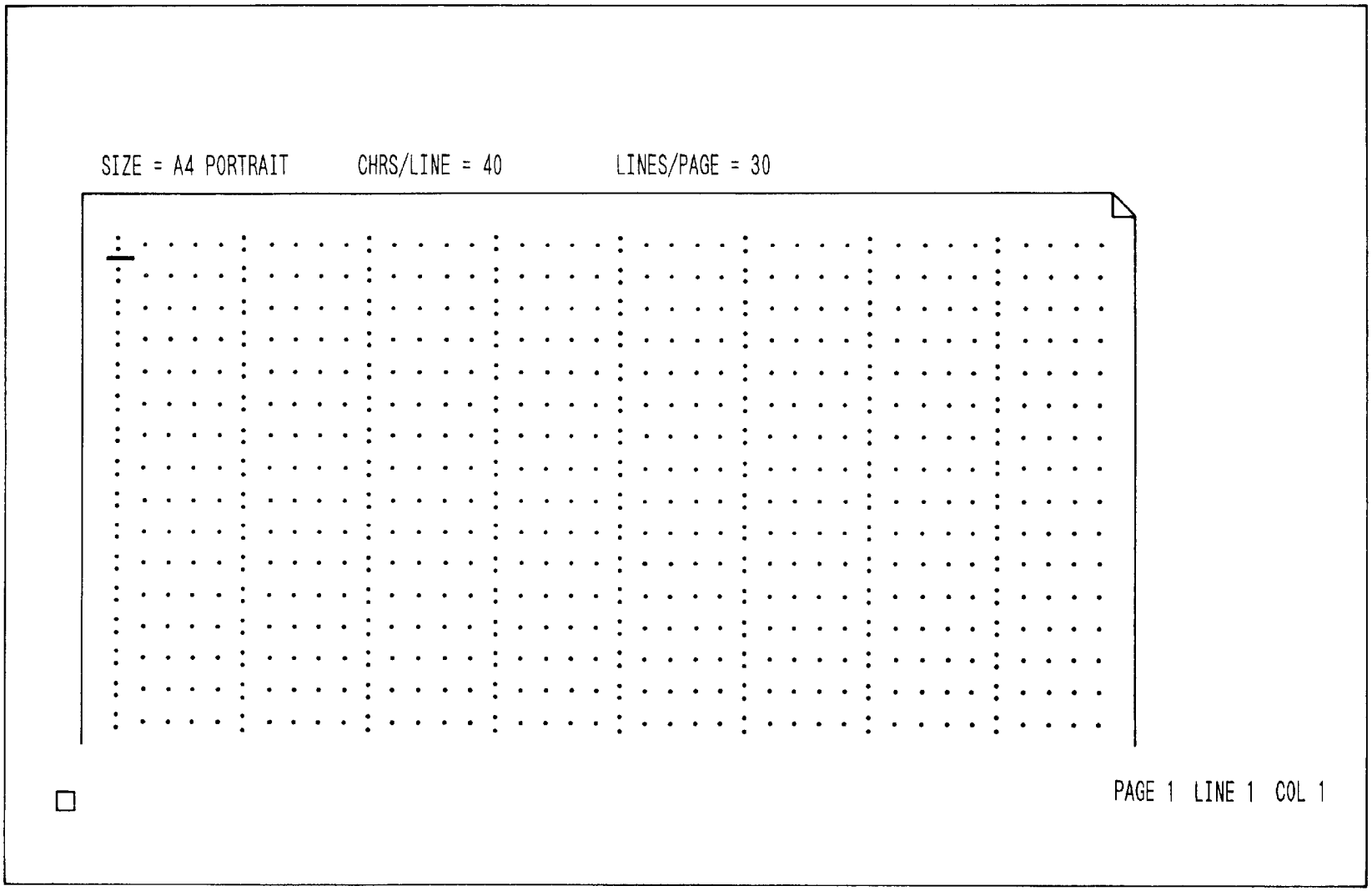
FIG. 6 is an explanatory diagram showing a new document forming screen which is displayed to the display of the document processing apparatus.
Figure 7:
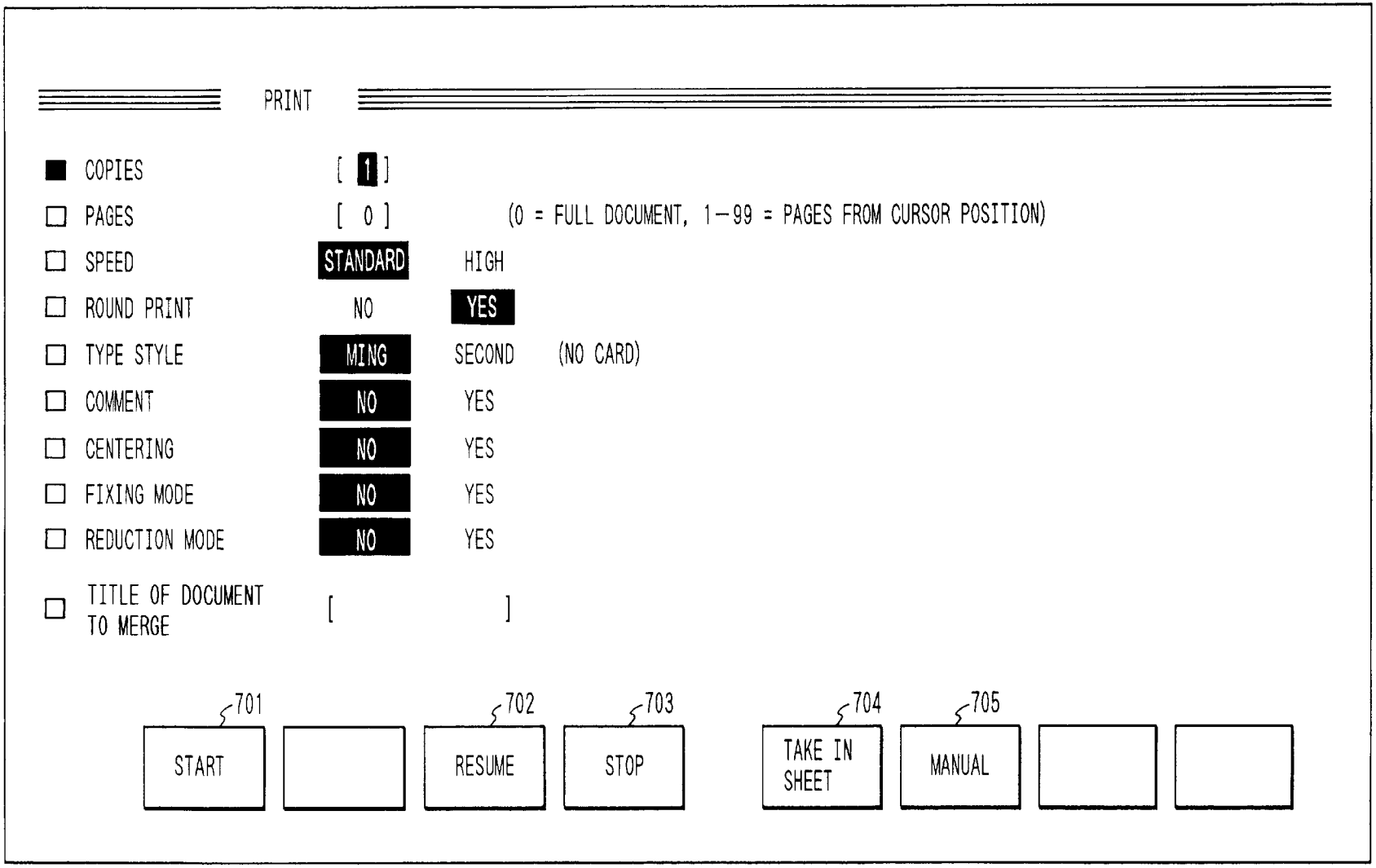
FIG. 7 is an explanatory diagram showing a print menu screen which is displayed to the display of the document processing apparatus.
Figure 8:
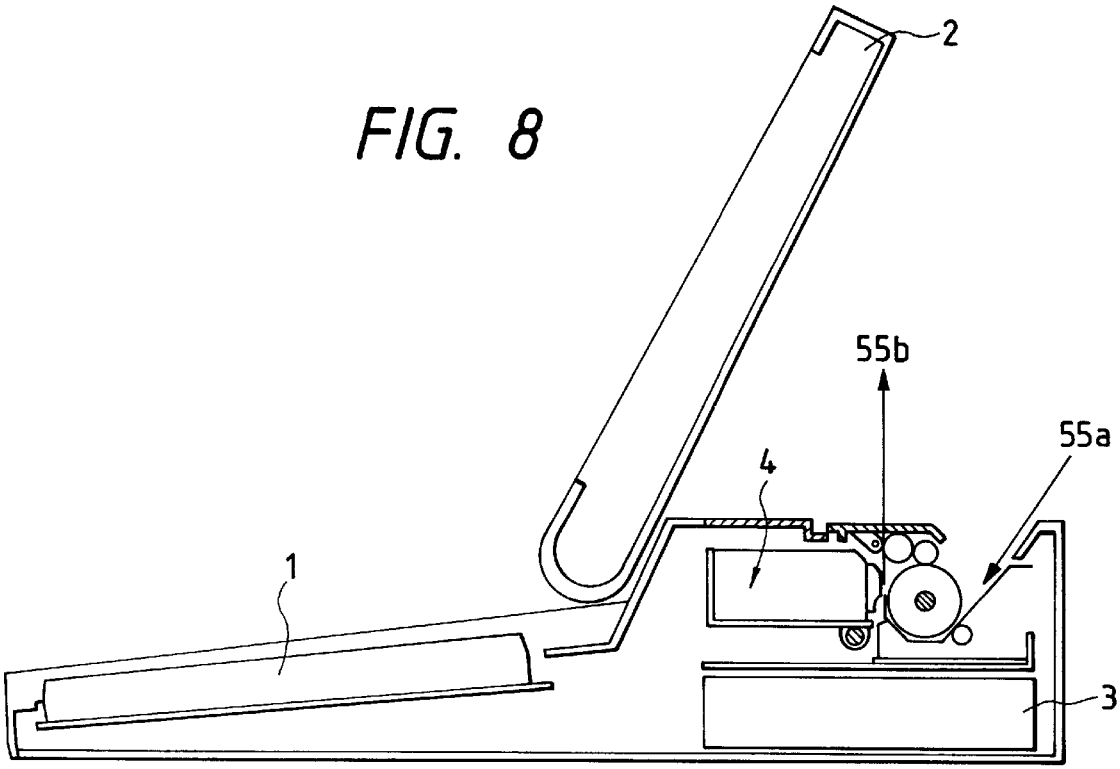
FIG. 8 is an explanatory diagram of a prior art.
Figure 9:
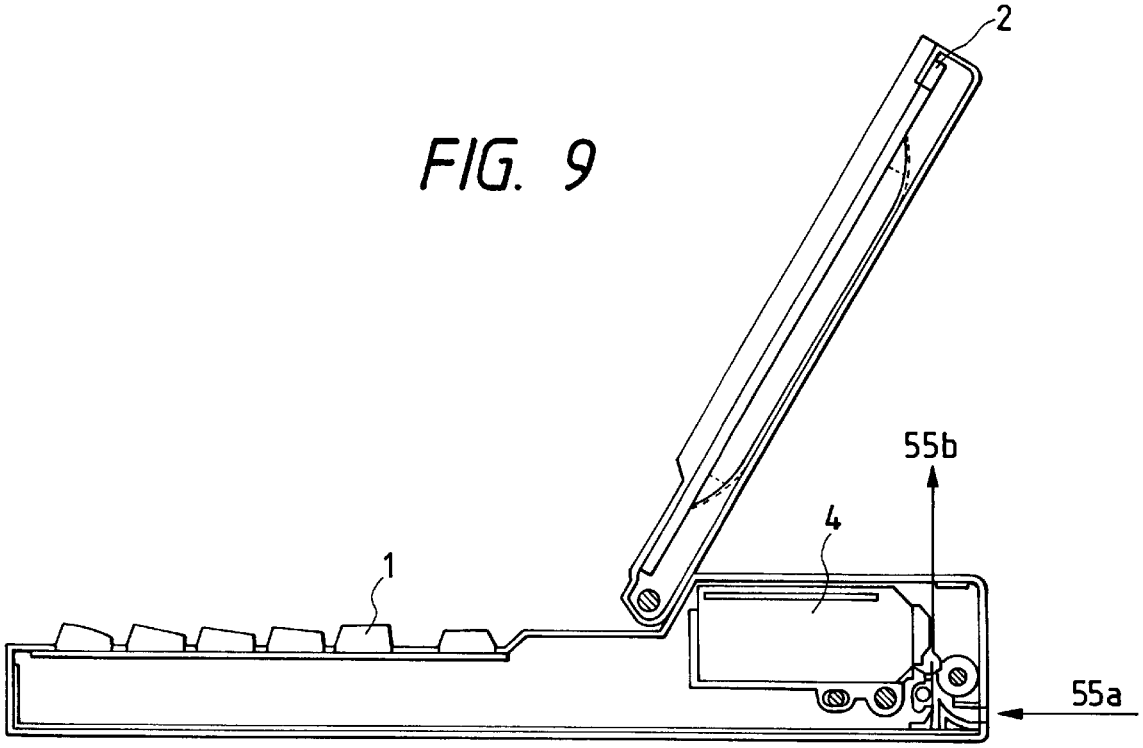
FIG. 9 is an explanatory diagram of a prior art.
Figure 10:
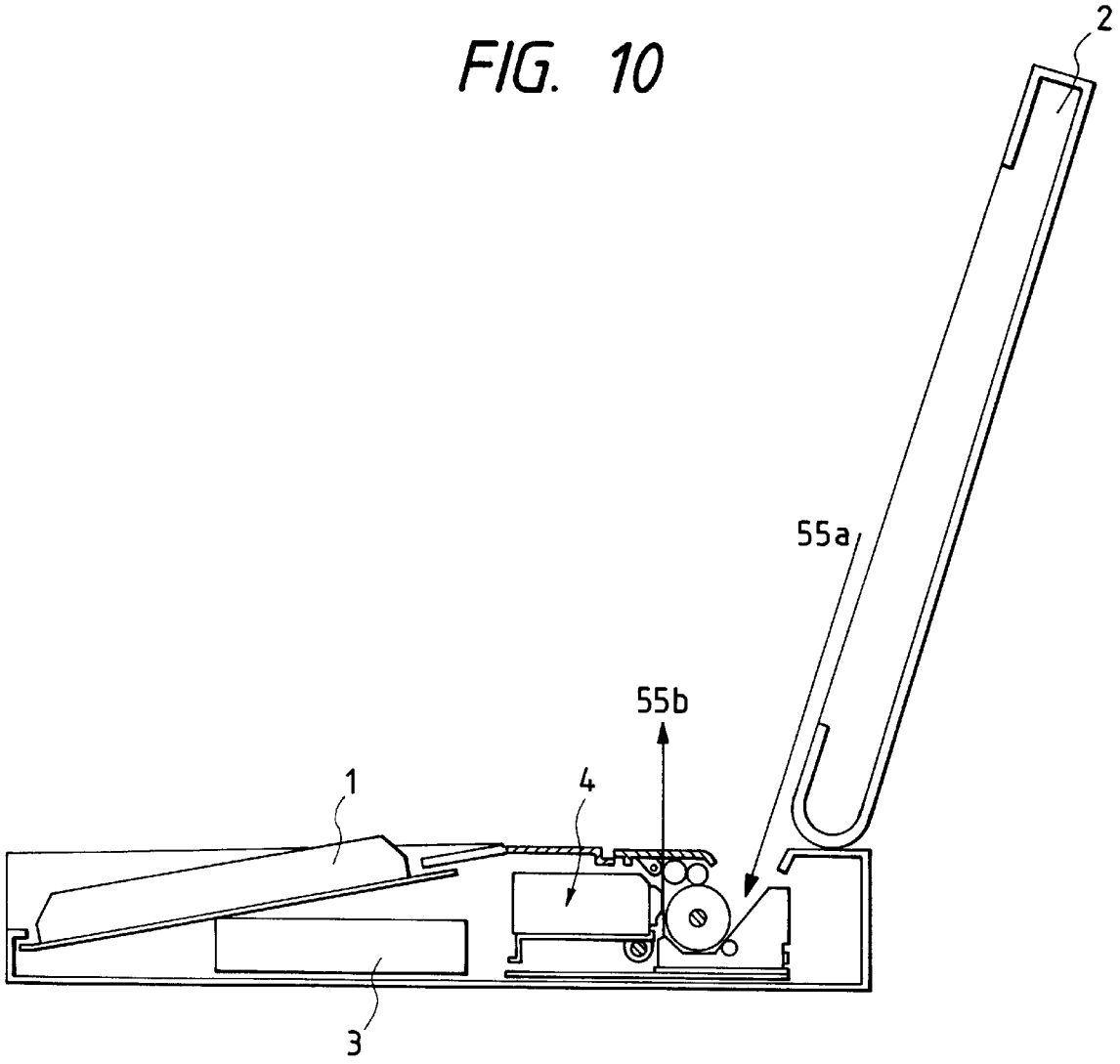
FIG. 10 is an explanatory diagram of a prior art.
Figure 11:
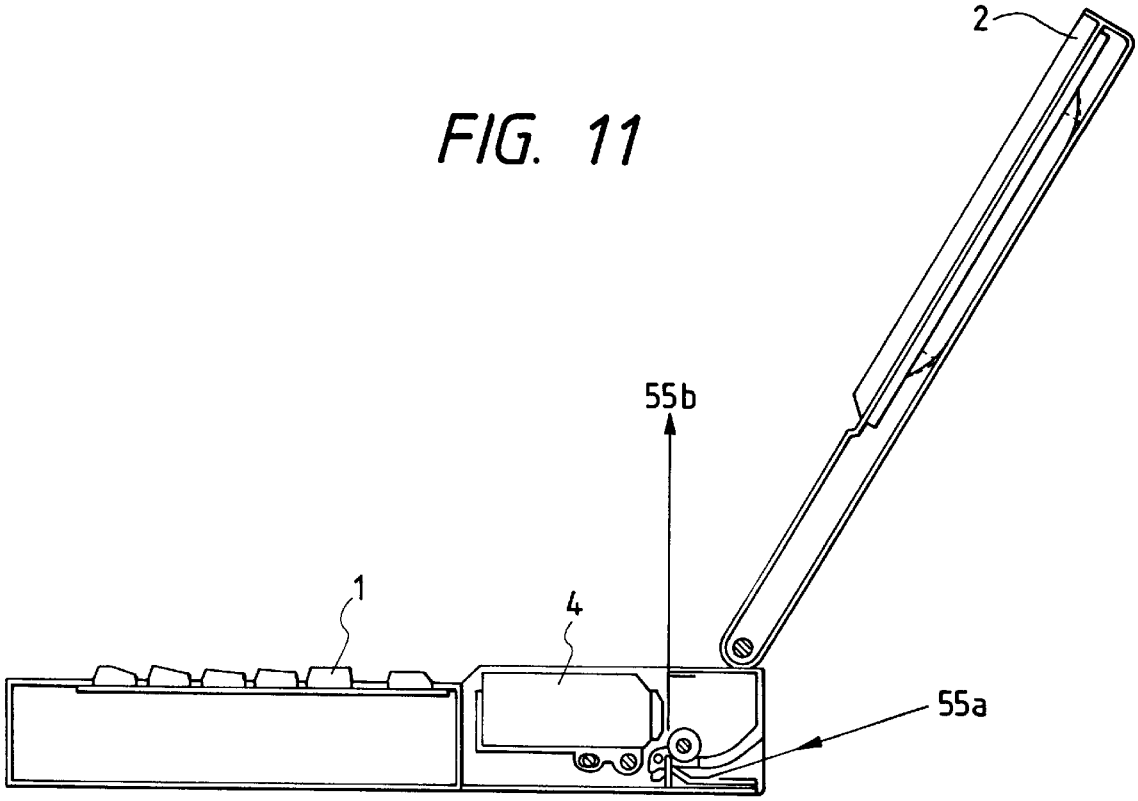
FIG. 11 is an explanatory diagram of a prior art.
Figure 12:
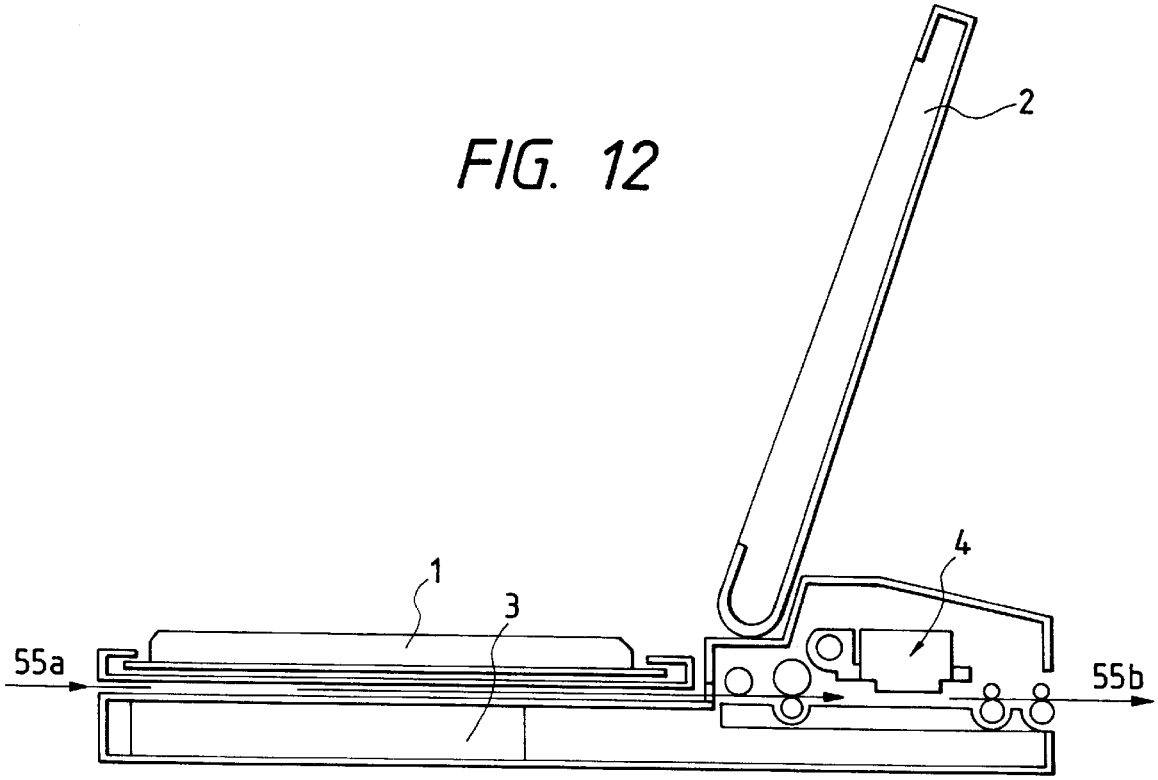
FIG. 12 is an explanatory diagram of a prior art.

First, when a power source of the apparatus main body is turned on (step S10), since the specific menu is not the print menu at present, the recording medium detecting function is turned off so as not to feed the recording medium (step S11). A document edit menu shown in FIG. 5 is displayed to the display 2 (step S12). Reference numeral 501 denotes a "return to document" menu to display a document editing screen of FIG. 6 to the display 2. Reference numeral 502 denotes a "new document" menu to newly display a document editing screen shown in FIG. 6 to the display; 503 a "document list" menu to display a list of documents stored in the floppy disk (FD); 504 a "save document" menu to store the edited document into the FD; and 505 a "print" menu to display a menu to print the edited document. Subsequently, in case of forming the document, the "new document" menu 502 is selected by using a cursor key 102 of the keyboard 1 and an enter key 101 of the keyboard 1 is depressed (step S13), so that the document editing screen is displayed to the display 2 (step S14). A document inputting operation is performed by using alphabet keys or the like of the keyboard 1 (step S15). When the document inputting operation is finished, a menu key 103 of the keyboard 1 is depressed (step S16). The processing routine is returned to the document edit menu in FIG. 5 (step S17). In case of recording the document formed, the "print" menu 505 in the document edit menu in FIG. 5 is selected by the cursor key 102 of the keyboard 1 and the enter key 101 of the keyboard 1 is depressed (step S18). Subsequently, since the menu displayed on the display 2 is the print menu, the recording medium detecting function to permit the conveyance of the recording medium is turned on (step S19). A print menu of FIG. 7 is displayed on the display 2 (step S20). Reference numeral 701 denotes a "start" menu to start the printing of the edited document; 702 a "resume" menu to resume the printing stopped by a "stop" menu 703; 703 the "stop" menu to temporarily stop the printing; 704 a "take-in sheet" menu to select a mode for taking in the recording medium after the recording medium was inserted after completion of the selection of a "manual" menu 705; and 705 the "manual" menu to select a mode to prevent the execution of an automatic take-in. When the recording medium is inserted into the recording medium feed port 4*i* in FIG. 1 (step S21), the recording medium detecting function operates and the recording medium is taken into the recording apparatus (step S22). When the "start" menu 701 is selected and the enter key is depressed (step S23), the printing is started (step S24). After completion of the printing, the recording medium is delivered to the outside of the apparatus main body (step S25). When the next printing is not performed, the menu key 103 of the keyboard 1 is depressed (step S26) and the print menu is finished. At this time point, when the recording medium is detected by the sheet sensor 8*a*, the recording medium is delivered (step S28). For example, in case of finishing the print menu without starting the printing in step S23, the recording medium is detected in step S28 and is delivered. The print menu is finished. Therefore, the recording medium detecting function is turned off to inhibit the conveyance of the recording medium (step S29). The processing routine is returned to the document edit menu in FIG. 5 (step S30).

The cursor key 102, enter key 101, and menu key 103 of the keyboard 1 are arranged at positions where their depressing operations are not obstructed by the recording medium P. A desired menu can be also designated by a pointing device (not shown).

[Description of the second embodiment]

The above embodiment has been described with respect to the case where the recording medium detecting function is turned on at the time of the print menu to record to the recording medium as an example. For recording apparatuses, with the recording head exchangeable for a reading head, which use the paper feed system and the reading head to provide a function of reading an image on a recording medium fed by the paper feed system, the recording medium detecting function may be turned ON/OFF also at the time of a certain specific menu, such as image read menu, in a manner similar to the foregoing embodiment.

[Description of the third embodiment]

In step S22 of the above embodiment, when the recording medium is detected, it is automatically taken in. However, it is also possible to construct in a manner such that after completion of the display of the print menu in step S20, when the user selects the "manual" menu in FIG. 7 and depresses the enter key, the user inserts the recording sheet and selects the "take-in sheet" menu in FIG. 7 and depresses the enter key 101, and the recording sheet is taken in. With such a construction, even the user who is not experienced in the automatic take-in operation can also certainly set the recording paper.

As described above, for a period of time from step S11 to step S17, even when the recording medium is set into the recording medium feed port, the recording medium is not conveyed. For a period of time from step S20 to step S26, by setting the recording medium into the recording medium feed port, the recording medium is conveyed to the recording apparatus. Namely, since the setting of the recording medium into the recording apparatus is permitted only for a period of time during which a certain printing mode is selected, in case of performing a process other than a certain printing mode, the recording medium doesn't remain in the feed path on the keyboard. Therefore, an inconvenience such that the keyboard cannot be depressed is eliminated and the document processing apparatus of a good operating efficiency can be provided. Since the user can select the automatic feeding mode of the recording medium, even the user who is not experienced in the automatic conveyance can certainly set the recording medium.

As described in detail above, according to the invention, it is possible to provide print control apparatus and method such that upon document processing in a non-recording mode, the apparatus can be set into a state in which no recording medium remains on the feed path or the recording medium can be soon removed, and a good operating efficiency of the recording medium is obtained irrespective of a degree of the skill of the user.

What is claimed is:

1. An information processing apparatus comprising:

display means for displaying information, wherein said display means displays a document editing screen on which document information can be edited with a keyboard and a print menu for printing information;

print means for printing information on a recording medium positioned above the keyboard;

paper feed means for automatically setting a recording medium at a recording start position when the recording medium is inserted into said apparatus at a predetermined position; and control means for controlling said paper feed means to automatically set the recording medium at the recording start Position when the recording medium is inserted at the predetermined position in the event that said display means displays the print menu and for controlling said paper feed means not to automatically set the recording medium at the recording start position when the recording medium is inserted at the predetermined position in the event that said display means displays the document editing screen.

2. An apparatus according to claim 1, further comprising detection means for detecting whether a recording medium is still set by said paper feed means, after said print means has printed the information on the recording medium, and paper ejection means for ejecting the recording medium if said detection means detects that the recording medium is still set by said paper feed means.

3. An apparatus according to claim 1, wherein said print means prints information on the recording medium in response to a print instruction given during a state in which the recording medium is set by said paper feed means.

4. An apparatus according to claim 1, further comprising a cursor key and an execution key provided at a position other than positions above which a recording medium is set by said paper feed means, wherein said print means starts printing information with said cursor key and said execution key.

5. An apparatus according to claim 1, wherein the document information is input with the keyboard.

6. An apparatus according to claim 1, wherein said display means further displays a list of documents stored and wherein said control means controls said paper feed means not to automatically set the recording medium at the recording start position when the recording medium is inserted at the predetermined position in the event that said display means displays the document list.

7. An apparatus according to claim 1, wherein said print means comprises a print head which can be replaced by a record head and wherein said display means further displays a read menu, and wherein said control means controls said paper feed means to automatically set the recording medium at the recording start position when the recording medium is inserted at the predetermined position in the event that said display means displays the read menu and controls said paper feed means not to automatically set the recording medium at the recording start position when the recording medium is inserted at the predetermined position in the event that said display means displays the document editing screen.

8. An apparatus according to claim 1, wherein the print menu includes a manual menu and a sheet take-in menu, and wherein said control means controls said paper feed means to automatically set the recording medium at the recording start position when the recording medium is inserted at the predetermined position in the event that both the manual menu and the sheet take-in menu are selected for execution.

9. A control method carried out in an information processing apparatus, said method comprising the steps of:

displaying, with a display means one of a document editing screen on which document information can be edited with a keyboard and a print menu for printing information;

printing information on a recording medium positioned above the keyboard;

automatically setting the recording medium at a recording start position when the recording medium is inserted into said apparatus at a predetermined position; and controlling the paper feeder to automatically set the recording medium at the recording start position when the recording medium is inserted at the predetermined position in the event that said display means displays the print menu and not to automatically set the recording medium at the recording start position when the recording medium is inserted at the predetermined position in the event that the document editing screen is displayed.

10. A method according to claim 9, further comprising the steps of detecting whether a recording medium is still set by the paper feeder, after the information on the recording medium has been printed, and ejecting the recording medium if said detection step detects that the recording medium is still set by the paper feeder.

11. A method according to claim 9, wherein the step of printing information on the recording medium is in response to a print instruction given during a state in which the recording medium is set by the paper feeder.

12. A method according to claim 9, wherein the apparatus is operated with a cursor key and an execution key provided at a position other than positions above which a recording medium is set by the paper feeder and further comprising the step of starting printing with the cursor key and execution key.

13. A method according to claim 9, wherein said displaying further displays a list of documents stored and wherein the recording medium is not automatically set at the recording start position when the recording medium is inserted at the predetermined position in the event that the document list is displayed.

14. A method according to claim 9, wherein printing is with a print head which can be replaced by a record head and wherein a read menu is displayed, and wherein said control step controls said paper feed to automatically set the recording medium at the recording start position when the recording medium is inserted at the predetermined position in the event that said display displays the read menu and controls said paper feed not to automatically set the recording medium at the recording start position when the recording medium is inserted at the predetermined position in the event that said display displays the document editing screen.

15. A method according to claim 9, wherein the print menu includes a manual menu and a sheet take-in menu, and wherein said paper feed is controlled to automatically set the recording medium at the recording start position when the recording medium is inserted at the predetermined position in the event that both the manual menu and the sheet take-in menu are selected for execution.

16. An article of manufacture comprising a computer usable medium having computer readable program code for carrying out a control method in an information processing apparatus, said method comprising the steps of:

displaying, with a display means one of a document editing screen on which document information can be edited with a keyboard and a print menu for printing information;

printing information on a recording medium positioned above the keyboard;

automatically setting the recording medium at a recording start position when the recording medium is inserted into said apparatus at a predetermined position; and controlling the paper feeder to automatically set the recording medium at the recording start position when the recording medium is inserted at the predetermined position in the event that said display means displays the print menu and not to automatically set the recording medium at the recording start position when the recording medium is inserted at the Predetermined position in the event that the document editing screen is displayed.

17. An article of manufacture according to claim 16, further comprising computer readable program code for carrying out the steps of detecting whether a recording medium is still set by the paper feeder, after the information on the recording medium has been printed, and ejecting the recording medium if said detection step detects that the recording medium is still set by the paper feeder.

18. An article of manufacture according to claim 16, further comprising computer readable program code for carrying out the step of printing information on the recording medium in response to a print instruction given during a state in which the recording medium is set by the paper feeder.

19. An article of manufacture according to claim 16, wherein the apparatus is operated with a cursor key and an execution key provided at a position other than positions above which a recording medium is set by the paper feeder and further comprising computer readable program code for carrying out the step of starting printing with the cursor key and execution key.

20. An article of manufacture according to claim 16, wherein said displaying further displays a list of documents stored and wherein the recording medium is not automatically set at the recording start position when the recording medium is inserted at the predetermined position in the event that the document list is displayed.

21. An article of manufacture according to claim 16, wherein printing is with a print head which can be replaced by a record head, wherein a read menu is displayed, and wherein said control step controls said paper feed to automatically set the recording medium at the recording start position when the recording medium is inserted at the predetermined position in the event that said display displays the read menu and controls said paper feed not to automatically set the recording medium at the recording start position when the recording medium is inserted at the predetermined position in the event that said display displays the document editing screen.

22. An article of manufacture according to claim 16, wherein the print menu includes a manual menu and a sheet take-in menu, and wherein said paper feed is controlled to automatically set the recording medium at the recording start position when the recording medium is inserted at the predetermined position in the event that both the manual menu and the sheet take-in menu are selected for execution.

* * * * *

UNITED STATES PATENT AND TRADEMARK OFFICE

CERTIFICATE OF CORRECTION

PATENT NO. : 5,904,428

DATED : May 18, 1999

INVENTOR(S) : YOSHIYUKI SHIMAMURA

It is certified that error appears in the above-identified patent and that said Letters Patent is hereby corrected as shown below:

COLUMN 1,
Line 21, "locating" should read --located--;
Line 30, "locating" should read --located--;
Line 50, "the" should read --a--;
Line 51, "the" (second occurrence) should read --a--; and
Line 66, "locating" should read --located--.

COLUMN 2,
Line 4, "by-a" should read --by a--;
Line 19, "which" should read --in which--;
Line 22, "Is" should read --is--;
Line 23, "It" should read --it--;
Line 28, "the from" should read --the time from--;
Line 50, "In" should read --in--; and
Line 57, "state.." should read --state.--.

COLUMN 3,
Line 11, "menu-screen" should read --menu screen--.

COLUMN 7,
Line 14, "Position" should read --position--.

UNITED STATES PATENT AND TRADEMARK OFFICE

CERTIFICATE OF CORRECTION

PATENT NO. : 5,904,428

DATED : May 18, 1999

INVENTOR(S) : YOSHIYUKI SHIMAMURA

It is certified that error appears in the above-identified patent and that said Letters Patent is hereby corrected as shown below:

COLUMN 8,
Line 4, "screen" should read --screens--; and
Line 65, "screen" should read --screens--.

COLUMN 9,
Line 12, "Predetermined" should read --predetermined--.

Signed and Sealed this

Thirtieth Day of November, 1999

*Attest:*

*Attesting Officer*

Q. TODD DICKINSON

*Acting Commissioner of Patents and Trademarks*